US005617107A

United States Patent [19]

Fleming

[11] Patent Number: 5,617,107

[45] Date of Patent: Apr. 1, 1997

[54] HEATED MICROWAVE ANTENNA

[75] Inventor: Terry L. Fleming, Roland, Ark.

[73] Assignee: Perfect Ten Antenna Co. Inc., Jacksonville, Ark.

[21] Appl. No.: 522,693

[22] Filed: Sep. 1, 1995

[51] Int. Cl.[6] ..... H01Q 1/02

[52] U.S. Cl. ..... 343/704; 343/912; 392/422

[58] Field of Search ..... 343/704, 912; 392/422, 420, 407; H01Q 1/02

[56] References Cited

U.S. PATENT DOCUMENTS

| | | | |
|---|---|---|---|
| 2,679,004 | 5/1954 | Dyke et al. | 343/704 |
| 3,805,017 | 4/1974 | Roberts et al. | 343/704 |
| 4,031,537 | 6/1977 | Alford | 343/704 |
| 4,866,452 | 9/1989 | Barma et al. | 343/704 |

*Primary Examiner*—Hoanganh T. Le
*Attorney, Agent, or Firm*—Stephen D. Carver

[57] ABSTRACT

A heated microwave antenna ideal for the direct broadcast satellite service, and heated conversion kits for retrofitting to conventional antennas. Antennas modified in accordance with the invention are highly weather resistant, as the dish is warmed to avoid snow and ice accumulation to prevent signal degradation. The heated microwave antenna mounts upon a mast that is bracketed to a satisfactory support. The dish focuses microwave signals upon a low noise broad band amplifier (LNB). The dish comprises multiple laminations from internal elements that are sandwiched together, and exhibits significant mechanical strength and substantial weather resistance. The preferred dish comprises a metallic reflector, a heated grid, an insulation layer, and a backing plate nested together to form a composite, laminated unit. The grid comprises a resistive heater element activated by a temperature-responsive thermostat. A concentric trim ring surrounding the dish periphery waterproofs the antenna. Optional LNB heaters are providing for warming and weatherproofing the LNB. Retrofit dish heating kits disclosed herein install upon conventional dish antennas. A heating kit adhesively retrofitted to a conventional dish comprises a heating grid and backing plate comprising a foam lined shell or insulator secured to the grid. An alternative heating kit comprises a backing plate enclosing an internal magnetic layer that retrofits the apparatus to the dish through magnetic attraction.

11 Claims, 7 Drawing Sheets

HEATED MICROWAVE ANTENNA

BACKGROUND OF THE INVENTION

The present invention relates generally to microwave antennas. More particularly, my invention relates to microwave antennas that are designed for receiving satellite broadcasts and that are heated to eliminate ice and snow buildup that otherwise causes signal loss. Further, this invention relates to auxiliary heaters for microwave receiving systems that may be retrofitted to existing antennas.

In the prior art a variety of large (i.e., larger than one meter in diameter) microwave and UHF dish antennas have been proposed. Relatively recently direct satellite broadcasting has become popular. Digital systems (i.e., systems sold under the trademark DSS™ have become popular. Satellites orbiting the earth at approximately 23,500 miles operate in the KU microwave band in the broadcast satellite service. Such satellites transmit digital, compressed television signals that can be received by relatively smaller dishes. The relatively small dishes typically employed to receive KU band signals are approximately eighteen to twenty inches in diameter, unlike the larger and more cumbersome antennas of the older C-band, which can be seven to twelve feet in diameter. Satellites in the direct satellite broadcast service transmit at approximately 120 watts rather than five watts, so a smaller antenna can be used successfully. KU-band satellites can be spaced apart at approximately nine degrees, allowing the antennas to aim at particular satellites with less mechanical movement.

Sophisticated digital signal processing techniques are used in direct broadcast satellite transmission. Digitization of the signal enhances bandwidth, and compression techniques enhance throughput. For example, direct satellite broadcasting systems employ MPEG (i.e., "Motion Picture Expert Group") compression. MPEG-2 is the new standard. Bandwidth is increased approximately seven fold over the older C-band analog systems. Further, adjacent channel selectivity is enhanced because of the technique.

Another advantage of modern direct broadcast KU-band satellite systems is that they employ circular polarization. With older antenna technologies the installer must tediously align the antenna elements responsive to horizontal and vertical components of the polarized signals to be received. Circular polarization techniques of the direct broadcast satellite service makes it much easier to aim and install the antenna. Additionally, better signal attenuation between adjacent satellites is realized.

Thus the smaller satellite dishes employed by the direct broadcasting satellite service are advantageous. They are widely gaining in popularity as users find that installation is quick and easy. Most importantly, since the satellite receiving antennas are relatively small, they do not create an eye sore, and they are less objectionable esthetically.

However, the band upon which such devices operate can be severely affected by various weather elements. In fact, during periods of heavy rain or snow, signal attenuation can be noted between the satellite and the receiver. More particularly, when ice or snow accumulates upon the antenna or the low noise broad band amplifier (i.e., the LNB), tremendous signal degradation is experienced. Particularly in northern climates, signal degradation of 20–30 db. can result from the accumulation of snow or ice upon the antenna. Snow or ice can accumulate directly upon the antenna in an uneven fashion, primarily distributed upon the bottom third of the dish. Snow or ice can also accumulate directly upon the LNB, degrading the ability of the waveguide to properly receive signals reflected by the dish.

Therefore, I have proposed a system for heating microwave antennas, particularly satellite dishes for the direct satellite broadcast service. A viable de-icing system must be easily incorporated into existing designs. Moreover, the system, should be capable of retrofitting. More particularly, a viable system must not interfere or degrade with signal transmission characteristics and must not alter the mechanical configuration or strength of the antenna. Such a system must be integrated into existing antennas without degrading the esthetics or ornamental appearance of the device and the system must function automatically without viewer attention or maintenance.

SUMMARY OF THE INVENTION

I have provided a heated microwave antenna that is ideal for receiving signals from direct broadcast satellites. The antenna is highly weather resistant and it is ideal for northern climates. The uniquely integrated heating system warms the dish and avoids accumulation of snow and ice that might otherwise degrade the received signal. I have also proposed kits embodying the concepts of the invention for retrofitting to preexisting dish antennas for immunizing them against snow and ice build-up.

My heated microwave antenna is mounted upon a suitable mast that is bracketed to a suitable support. The heated dish bounces microwave signals towards a conventional LNB. The dish is formed from multiple laminations or elements that are sandwiched together. This construction results in enhanced mechanical strength and improved weather resistance.

Preferably the dish comprises a galvanized, steel reflector, a similarly shaped heated grid, a foam insulation layer, and a backing plate. All are assembled and glued together to form a composite, laminated structure. The rear backing plate is mechanically identical to the reflector. The grid has a distributed resistive heater element disposed upon a plastic substrate. The heater is activated by a thermostat when temperature decrease below 34 degrees F. The backing plate sandwiches the grid and the optional insulator against the reflector. A vinyl trim ring tightly encircling the dish periphery seals it against the elements.

Heat generated by the grid is concentrated by the foam insulator upon the front reflector. In other words, the antenna reflective portion that is most likely to be exposed to snow and ice is heated the most. The foam insulator reduces heater element wattage by 40 percent. The removal of snow and ice from the antenna rear does not improve reception.

I have also provided optional LNB heaters that may be quickly coupled to the antenna LNB. One form of my new LNB heater is ideal for retrofitting to preexisting antennas. The preferred embodiment comprises a flexible plastic strip containing an internal heating element. It is simply wound about the LNB, and its ends are secured with fasteners preferably comprising with Velcro™-brand material. An integral hood portion surmounts the LNB top, occluding the entry of snow or rain. An electrical plug easily interfaces the unit with the antenna heater power supply.

An alternative LNB heater comprises a resilient, generally cylindrical cap adapted to be snap-fitted to the LNB housing. A suitable thermostat controls an electric resistive heater element circumferentially wound within the tubular cap body.

My retrofit dish heating kits may be easily installed upon conventional dish antennas. My heater kit has an adhesively coated, resistive grid that may be installed by first peeling away a paper covering. A similar backing plate has a plastic, foam lined shell that is adhesively secured to the grid at the factory. A peel-off covering is simply removed from the unit (i.e., the grid) for subsequent installation, and the heater is pressed unto the rear of the dish. Alternatively, the backing plate and thus the kit can be fastened magnetically.

In another embodiment the retrofit kit includes a separate insulator that is adhesively attached to the grid. The backing plate includes a plastic shell encapsulating an internal magnetic layer that readily attaches to the dish. Alternatively the plate may additionally be adhesively coated as above.

Thus, it is the primary object of my invention to provide a direct broadcast satellite antenna that resists icing and snow accumulation.

More particularly, it is an object of my invention to provide a high gain, stable and esthetically pleasing antenna for direct broadcast satellite reception that will not experience signal degradation from snow or ice accumulation.

A related object is to provide a direct broadcast satellite antenna of the character described that is ideal for northern climates.

Another object is heat both the antenna dish and the LNB.

Another fundamental object of my new antenna invention is to provide a direct broadcast satellite antenna that is resistant to the accumulation of snow and ice.

A related object is to provide a direct broadcast satellite antenna that resists the accumulation of snow and ice through a heating system incorporated into the structure of the antenna. It is a feature of the invention that multiple laminations or layers are sandwiched together to provide efficient heating while preserving structural integrity.

A still further object is to provide a heating system for microwave antennas that does not materially alter the overall ornamental appearance.

Another object is to provide a heating system for microwave antennas that does not detrimentally affect signal reception.

Another basic object is to provide a direct broadcast satellite antenna system of the character described that is ideal for use in geographic areas experiencing severe winters and freezing precipitation.

Another fundamental object is to provide a direct broadcast satellite antenna of the character described that is invulnerable to ice storms.

Yet another important object is to provide kits for heating dish antennas that exhibit the advantages listed above.

A still further important object is to provide kits for heating conventional LNB's used with dish antennas.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
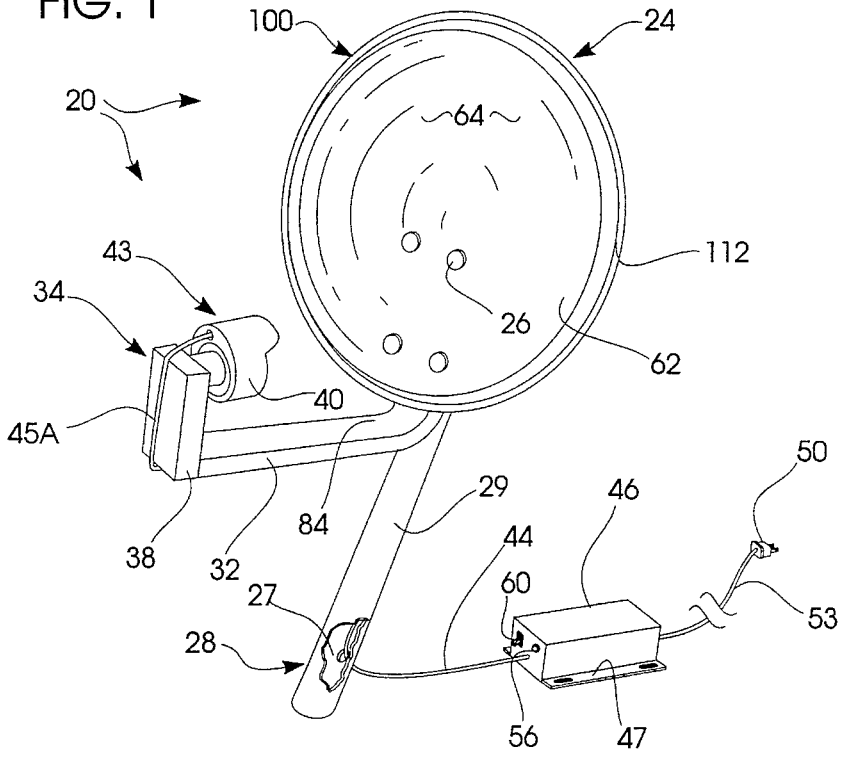
FIG. 1 is a fragmentary isometric view of my Heated Microwave Antenna.

With initial reference now directed to FIGS. 1–4 of the appended drawings, a preferred embodiment of my heated microwave antenna has been generally designated by the reference numeral 20. The herein-described antenna is ideal for reception of signals from direct broadcast satellites.

Figure 2:
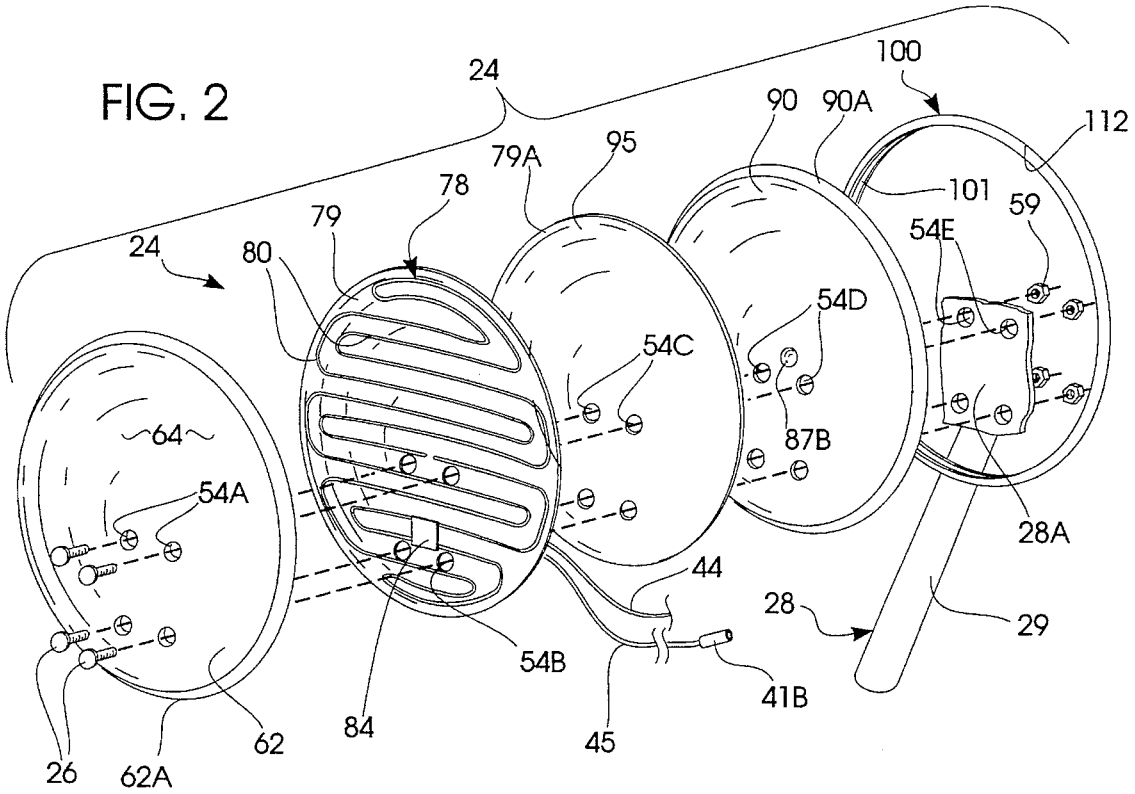
FIG. 2 is a fragmentary, exploded isometric view of the preferred dish.

The preferred antenna comprises a dish 24 secured by a plurality of spaced apart mounting bolts 26 to a rigid, upright mast 28. Mast 28 comprises an elongated tube 29 having a mounting plate 28A at its top (FIG. 2). The tube bottom can be mounted to a supporting structure through appropriate brackets (not shown) to aim the apparatus properly towards the satellite from which reception is sought.

Mast 28 supports an elongated standoff 32 that projects generally horizontally away from the dish. A conventional low noise broad band amplifier (LNB) has been generally designated by the reference numeral 34. Typical LNB devices are well known in the industry, and they are readily available from companies such as Grundig, California Amplifier, etc. Their purpose is to detect KU-band microwave signals reflected towards them by the dish, and to frequency translate the signals for transmission via coaxial cable to the downstream electronics. The generally rectangular LNB circuit housing 38 is mated to the outer, tubular open end of standoff 32. LNB heating apparatus 43 warms the LNB and waveguide 35 to a cylindrical, snap-on cap 40 that mates to the LNB waveguide 35 (FIG. 4), as detailed hereinafter.

Figure 3:
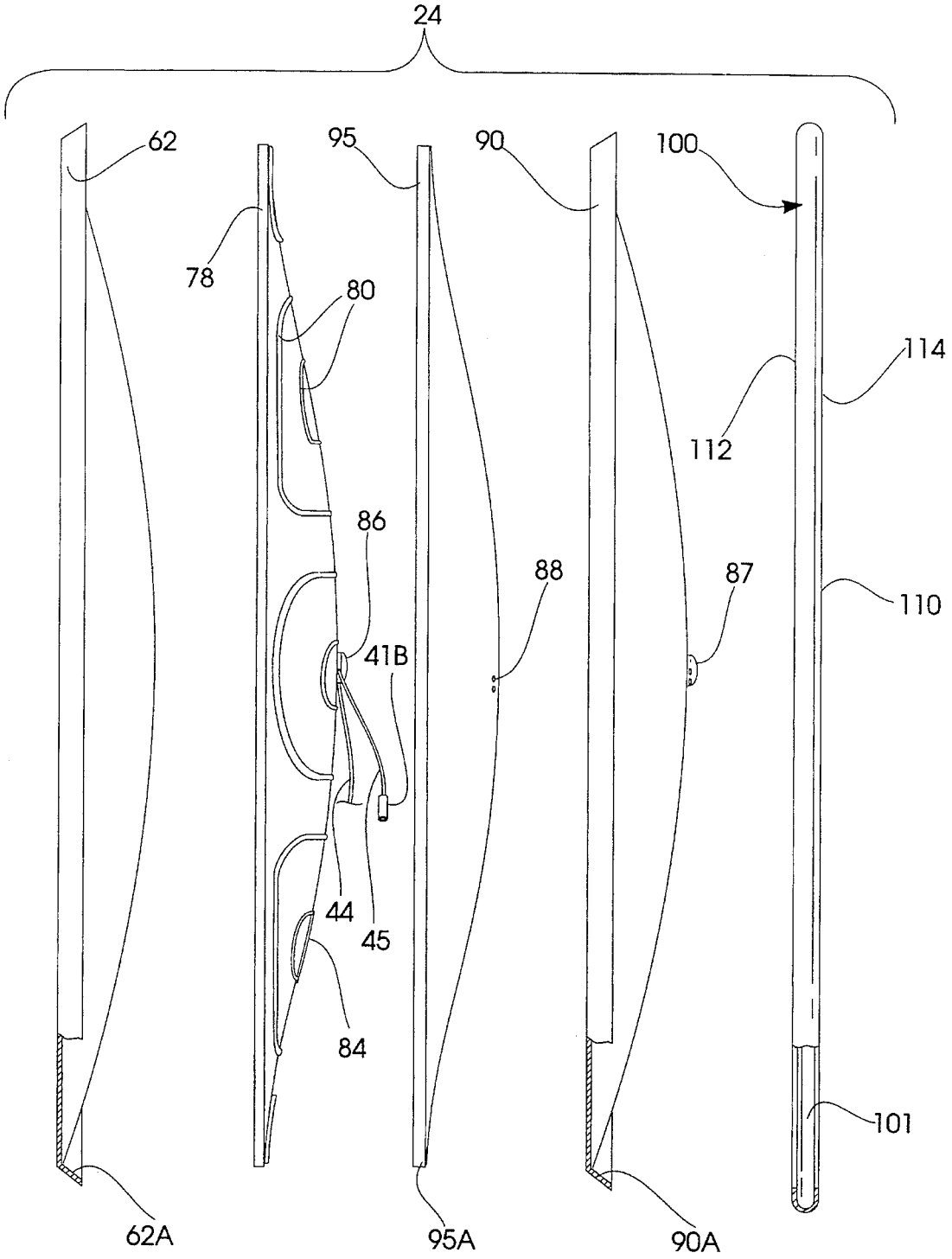
FIG. 3 is an enlarged, exploded side elevational view of the preferred dish.

With primary attention directed to FIGS. 2 and 3, the antenna dish 24 preferably comprises a plurality of similarly shaped elliptical elements that are layered together to form a laminated composite structure. Dish 24 comprises an elliptical, galvanized steel reflector 62 having a configured surface 64 that is projected towards the LNB. Signals reflected from surface 64 are concentrated in the LNB 34 as is the usual fashion with dish antennas. Orifices 54A are penetrated by the mounting bolts 26.

Preferably a similarly shaped elliptical grid 78 provided with resistive windings 80 is adhesively secured to the generally convex rear of the reflector 62. The grid substrate 79 is preferably formed of plastic. Mounting orifices 54B align with dish orifices 54A discussed previously. The electrically resistive winding 80 is controlled by a thermostatic element 84 that closes the circuit when the temperature decrease below 34 degrees F. A central orifice (not shown) receives a plastic fitting 86 that passes conduit 44 and branch conductor 45 (FIG. 3) outwardly. Conductor 45 terminates in a plug 41B for powering the optional LNB heater(s).

An elliptical backing plate has been designated by the reference numeral 90. Plate 90 is identical to reflector 62. The preferably galvanized metallic plate sandwiches an optional, elliptical insulator 95 against the rear of the grid 78. The insulator 95 preferably comprises plastic foam. Bolts 26 penetrate the aligned mounting orifices 54C, 54D. When the fasteners 59 are tightened, the entire assembly is forced together in a sandwiched or laminated fashion and the elliptical backing plate 90 sandwiches the grid 78 and the elliptical insulator 90 between itself and the front reflector 62. Conduit 44 passes through suitable orifices 88 in insulator 95 and through fitting 87 (FIG. 3) in backing plate 90, and is thereafter preferably routed through the tubular interior 27 of mast 28.

For weatherproofing, the outer peripheral lip of each elliptical element is captivated and sealed by a concentric trim ring generally designated by the reference numeral 100. Trim ring 100 is preferably formed of vinyl, and it is sealed in place concentrically about the dish circumference by silicone sealant. For example, lip 62A, insulator lip 95A, and plate lip 90A are tightly meshed together in assembly. The plastic trim ring 100 defines an internal channel 101 (FIGS. 2, 3) between which the nested and meshed lips are captivated. The ring has an external circumference 110 (FIG. 3) and a pair of sides 112 and 114 that sandwich and abut against the upper peripheral lips of the previously described dish elements. The ring 100 thus helps maintain the elements in proper operative alignment and seals them against the weather to prevent moisture from entering the antenna.

The composite laminated antenna dish structure is tightly compressed by the mounting bolts 26. As indicated in FIG. 2, the mounting bolts 26 project through aligned orifices 54A, 54B, 54C, 54D in the antenna elements, and through similar aligned orifices 54E in mast plate 28A to secure the sandwiched elements. The fastening nuts 59 are secured to the ends of bolts 26 to fasten the composite dish to mast 28.

Figure 4:
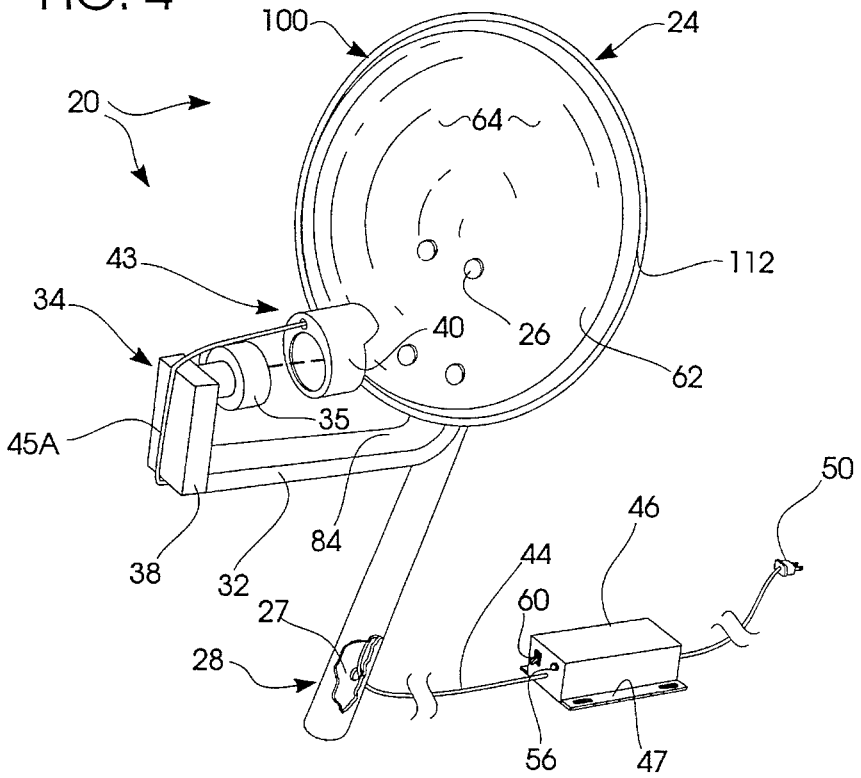
FIG. 4 is a partially fragmentary and partially exploded isometric view of my new antenna showing the optional LNB deicing heater partially removed.
Figure 5:
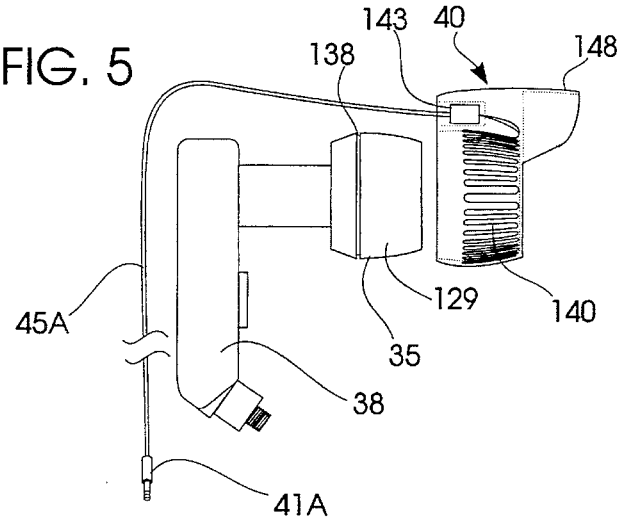
FIG. 5 is an enlarged, fragmentary side elevational view showing the deicing cap separated from the LNB.
Figure 5A:
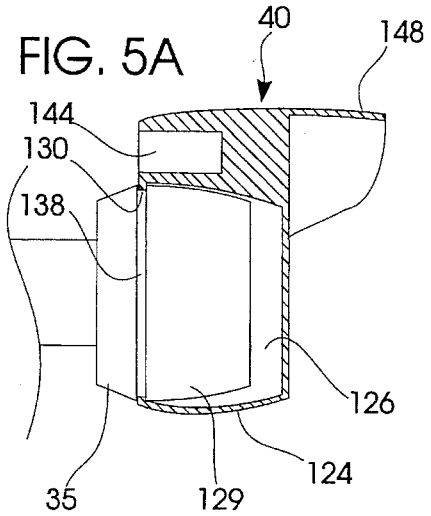
FIG. 5A is an enlarged, fragmentary sectional view of the LNB deicing cap.
Figure 5B:
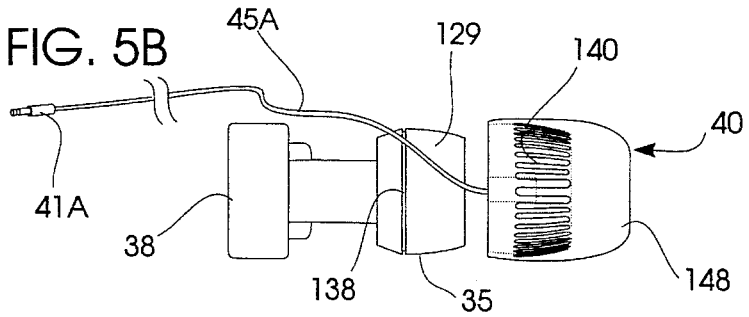
FIG. 5B is an enlarged, fragmentary and partially exploded top plan view of the deicing cap.

Turning now to FIGS. 4 and 5–5B, a first embodiment of an optional LNB heater 43 is illustrated. In FIGS. 5 and 5B it is disassociated from the LNB waveguide 35. The LNB heating unit 43 comprises a generally cylindrical cap 40 having tubular edges 124 forming an open region 126 (FIG. 5A) adapted to be fitted to the circumferential flange 129 of the LNB. Region 126 is circumscribed by a deflectable lip 130 integrally formed in cap 40. As cap 40 is moved towards the LNB (i.e., towards the left as viewed in FIGS. 5 or 5B), an internal lip 130 (FIG. 5*a*) snap fits into the recessed groove 138 of the LNB (FIG. 5). Power is supplied through electrical conduit 45A that activates the electric resistive heater elements 140 disposed within the cap 40 structure. Conduit 45A includes plug 41A that simply plugs into conduit plug 41B (FIG. 3) when the LNB heater is added. Thermostatic switch 143 disposed within the cap compartment 144 activates the cap heating element when the monitored temperature drops below 34 degrees F. A hood portion 148 of the heater 40 prevents precipitation accumulation within the mouth of the LNB.

Figure 6:
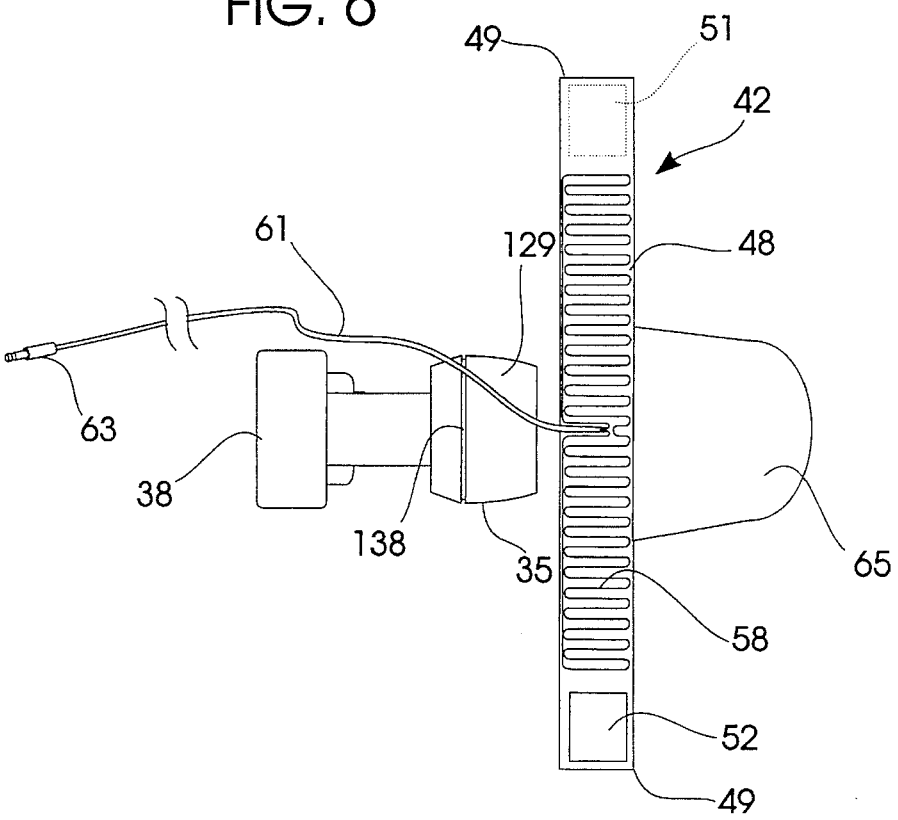
FIG. 6 is a top plan view of the preferred, folding strip LNB heater.
Figure 6A:
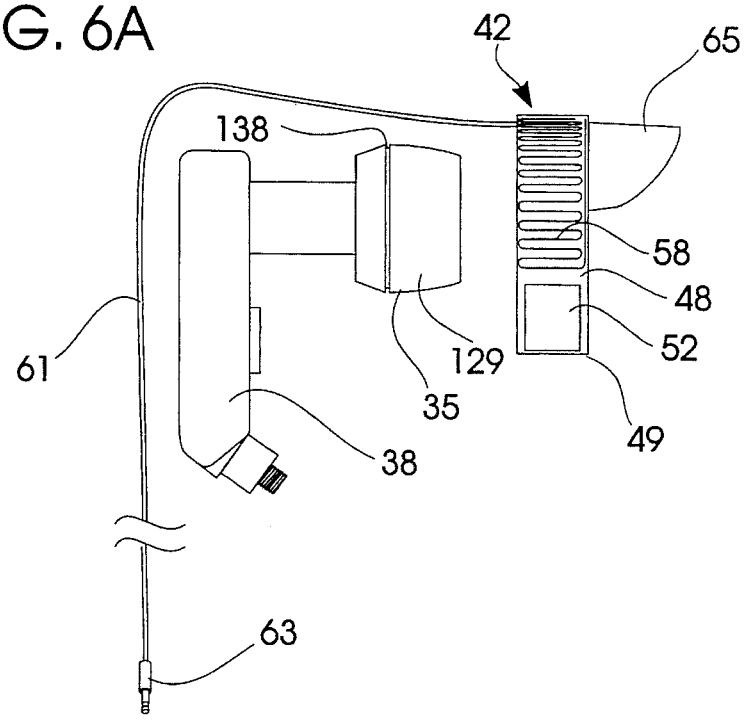
FIG. 6A is a partially exploded elevational view of the folding strip LNB heater and the associated LNB.

Preferred LNB strip heater 42 (FIGS. 6–6A) comprises an elongated, generally foldable plastic body 48 whose opposite ends 49 are provided with Velcro™ fasteners 51 and 52 for easy installation about the LNB waveguide 35. A resistive winding 58 is encapsulated within the resilient body of the strip heater 42, and it is powered by line 61 with a conventional plug 63 that connects to plug 41B (FIG. 3). A hood portion 65 of the heater projects outwardly from the LNB after installation to occlude the passage of precipitation.

Figure 11:
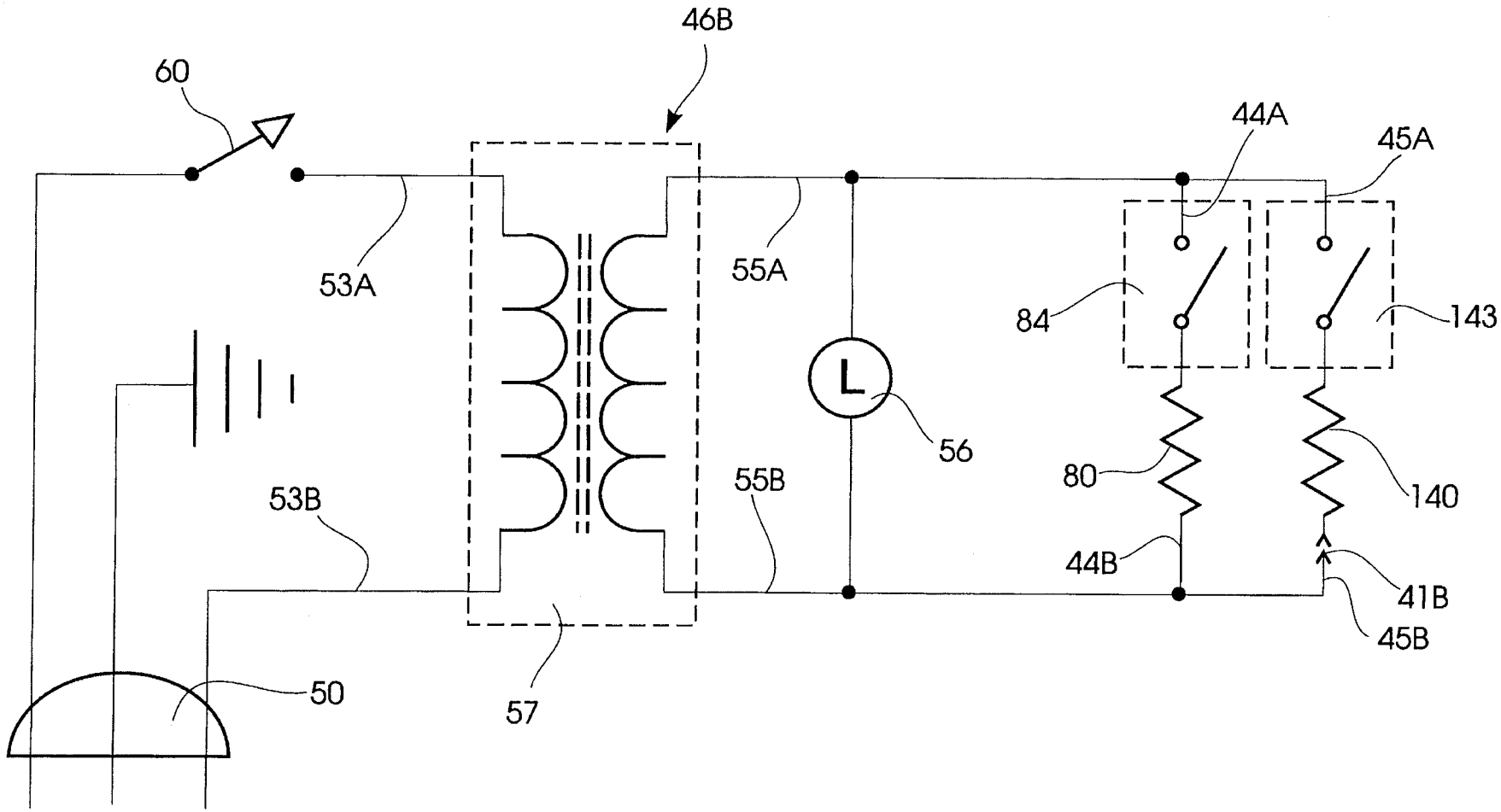

With joint reference to FIGS. 4 and 11, a power supply 46 provides voltage to the dish and LNB heaters. Conduit 44 leading to grid 78 powers the dish heater element. A conductor branch 45 coupled to conduit 44 powers the LNB heater(s). Power supply 46 comprises a generally cubicle, metallic housing that includes depending flanges 47 for easy mounting. Its circuit 46B (FIG. 11) receives power from a three-prong plug 50 that applies 120 v.a.c. RMS on conduit 53 (i.e., across conductors 53A, 53B) to the primary winding of isolating step-down transformer 57. Nominally 28 v.a.c. RMS appears from the transformer secondary across lines 55A, 55B, activating pilot light 56. Main switch 60 is activated to turn on the power supply. Conduit 44 comprises circuit wires 44A, 44B in FIG. 11, that power the resistive winding 80 when the thermostat 84 (FIG. 2) is closed. Conduit 45 comprises conductors 45A, 45B (FIG. 11) that power the resistive LNB heater 140 when the thermostatic switch 143 is closed.

Figure 7:
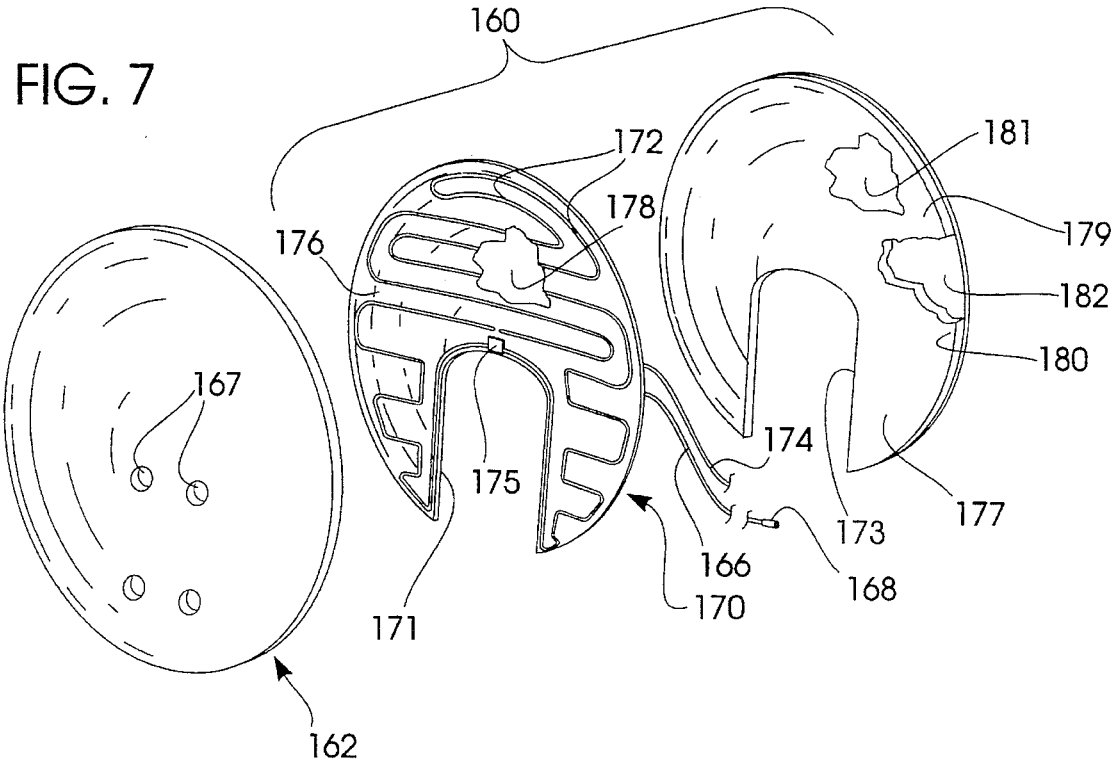
FIG. 7 is an exploded, fragmentary isometric view of an alternative heater adapted to be retrofitted to conventional existing antennas.
Figure 8:
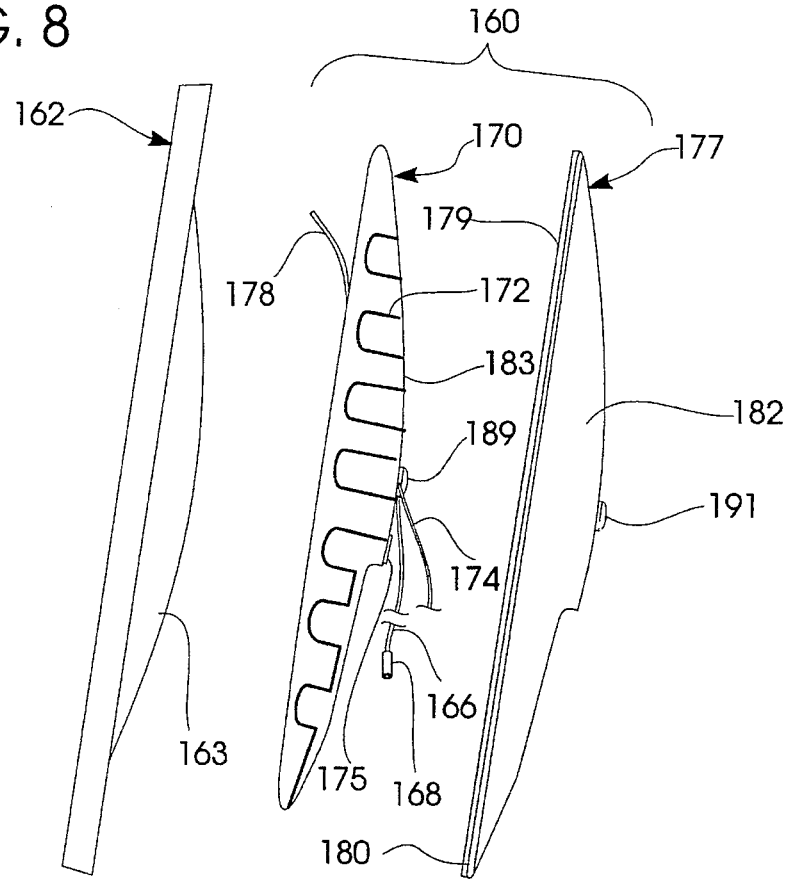
FIG. 8 is an enlarged, exploded side elevational view of the embodiment of FIG. 7.

With reference now to FIGS. 7 and 8, a first embodiment of a retrofit kit has been identified by the reference numeral 160. Heater kit 160 is adapted to be retrofitted to a conventional microwave receiving dish 162 that is supplied unheated. The heater grid has been generally designated by the reference numeral 170. It includes an internal heating element 172 powered by conduit 174 connected to branch 166 that has a plug 168 for quick connection to the LNB heater(s). Element 172 is controlled by a series-connected thermostat 175. The heating element 172 is disposed upon the front surface 176 of the grid. Surface 176 is preferably adhesively coated. The surface is exposed for assembly and installation by removing the paper covering 178. The covering 178 is peeled off by the installer prior to retrofitting the kit 160 to the conventional dish 162. With the covering 178 removed, the grid is pressed unto the generally convex rear 163 (FIG. 8) of the dish 162.

A similarly profiled backing plate 177 has a front, generally concave foam surface 179 for insulating the kit, secured by a resilient, rear plastic shell 182. The foam surface 179 is coated with adhesive 181 for connection to the grid 170 at the factory. Once the covering 178 is removed, the kit 160 is pressed unto the generally convex rear 163 of the dish 162. Alternatively, the backing plate and thus the kit can be fastened magnetically as explained in conjunction with FIG. 9 hereinafter.

Dish 162 includes mounting orifices 167 for attachment to a support similar to plate 28A (FIG. 2) previously described. The rearwardly projecting mounting bolts (not shown) are similar to bolts 26 (FIG. 2) and they terminate in a plate comparable to plate 28A (FIG. 2). Clearance for the bolts and the mounting plate to which they are secured is provided by notches 171 and 173. Conduit 174 may be routed through fittings 189 and 191 (FIG. 8).

Figure 9:
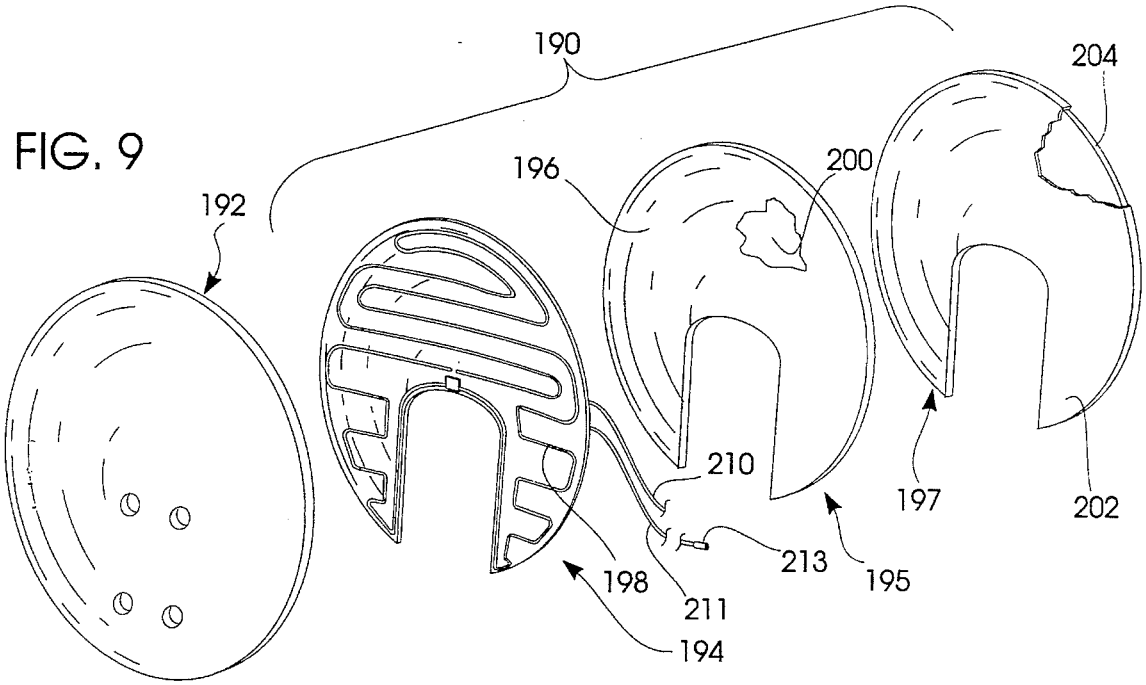
FIG. 9 is a exploded isometric view of another embodiment showing an alternative retrofit heater.

As seen best in FIG. 9, an alternative conversion kit has been generally designated by the reference numeral 190. Kit 190 also mounts to a conventional direct broadcast dish that has been designated by the reference numeral 192. Grid 194 includes resistive heater winding 198. Conduit 210 powers the grid and branch 211 includes plug 213 for optional connection to the LNB heaters(s). The grid is backed with a separate similarly-profiled foam insulator 195 that is sandwiched to the grid by the backing plate 197. Foam surface 196 is coated with adhesive 200 for bonding to the grid rear. Heat from grid 194 is concentrated upon the dish 192 by the presence of the insulator 195, that is pressed into position by the plate 197.

Figure 10:
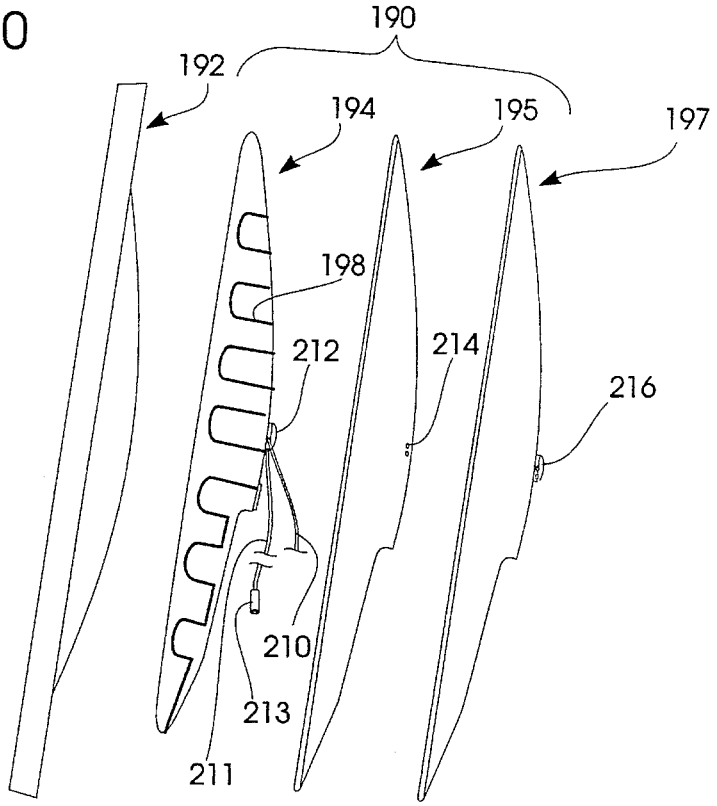
FIG. 10 is a enlarged, exploded side elevational of the embodiment of FIG. 9; and, FIG. 11 is an electrical schematic diagram of the preferred heater circuit.

Plate 197 may be adhesively mounted to the rear of insulator 195. It may comprise a plastic shell having surfaces 202 encapsulating an internal magnetic layer 204 of the type used in conventional, removable magnetically mounted vehicle signs. Layer 204 thus comprises an encapsulated, pliable layer of magnetized steel particles. In this instance kit 190 is secured upon dish 192 both by adhesive forces from the grid and the magnetic force from the plate. Alternatively plate 197 may be adhesively mounted like plate 177 described previously. Conversely, plate 177 may be magnetically attached like plate 202. Conductors 210 may be routed as desired through fitting 212, orifice 214, and fitting 216 (FIG. 10) in a fashion similar to that previously explained.

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A heated microwave antenna receiving system comprising:

a dish adapted to be aimed at a source of microwave signals, said dish comprising:

a reflector for focusing signals, said reflector having a shape comprising a generally concave front surface and a generally convex rear surface;

a generally concave, electrically resistive grid coupled directly to said convex reflector rear surface in thermal conductive relation thereto, said grid configured substantially the same shape as said reflector;

a generally concave thermal insulator configured substantially the same shape as said reflector and attached directly behind said grid;

a backing plate configured substantially the same shape as said reflector attached to the rear of said reflector to forcibly sandwich the grid between said reflector and said insulator to maximize thermal transfer between said grid and said reflector through thermal conduction; and, trim ring means for forcibly securing said reflector, said grid and said plate together in abutting, sandwiched relation;

low voltage means for activating said grid in response to a preselected temperature;

low noise amplifier means for receiving signals projected towards it by said dish;

means for securing said low noise amplifier means in position aimed at said dish; and, means for securing said antenna to a supporting structure.

2. The microwave antenna receiving system as defined in claim 1 including means for heating said low noise amplifier means, said means for heating comprising a heated cover that snap fits to said low noise amplifier means.

3. The microwave antenna receiving system as defined in claim 1 further comprising means for heating said low noise amplifier means comprising a flexible, electrically heated strip that fits around said low noise amplifier means.

4. A heating kit adapted to be retrofitted to microwave antennas of the type comprising a low noise amplifier and reflector dish for focusing signals upon said low noise amplifier, said reflector dish having a shape comprising a generally concave front surface and a generally convex rear surface, said kit comprising:

a generally concave, electrically resistive grid coupled directly to said convex reflector dish rear surface in thermal conductive relation thereto, said grid configured substantially the same shape as said reflector dish;

a generally concave thermal insulator configured substantially the same shape as said reflector dish and forcibly attached directly thereto behind said grid;

a backing plate configured substantially the same shape as said reflector dish attached to the rear of said reflector to forcibly sandwich the grid between said reflector dish and said insulator to maximize thermal transfer between said grid and said reflector dish through thermal conduction;

means for forcibly securing said reflector, said grid and said plate together in abutting, sandwiched relation wherein the grid is pressed towards said reflector; and, low voltage means for activating said grid in response to a preselected temperature.

5. The heating kit as defined in claim 4 wherein said heating kit is adhesively secured to said dish.

6. The heating kit as defined in claim 4 wherein said heating kit is magnetically secured to said dish.

7. The heating kit as defined in claim 4 including means for heating said low noise amplifier.

8. The heating kit as defined in claim 4 wherein said grid and said backing plate are notched so the heating kit may be retrofitted without disassembling the dish.

9. A heated microwave antenna system comprising:

a rigid mast adapted to be secured to a supporting structure;

a dish supported by said mast and adapted to be aimed at a microwave source of signals, said dish comprising:

a reflector for focusing signals, said reflector having a shape comprising a generally concave front surface and a generally convex rear surface;

a generally concave, electrically resistive grid coupled directly to said convex reflector rear surface in thermal conductive relation thereto, said grid configured substantially the same shape as said reflector;

a generally concave thermal insulator configured substantially the same shape as said reflector and attached directly behind said grid;

a backing plate configured substantially the same shape as said reflector attached to the rear of said reflector to forcibly sandwich the grid between said reflector and said insulator to maximize thermal transfer between said grid and said reflector through thermal conduction; and, trim ring means for forcibly securing said reflector, said grid and said plate together in abutting, sandwiched relation;

low noise amplifier means for receiving signals projected towards it by said dish;

means for heating said low noise amplifier means; and, low voltage means for activating said grid heater and said low noise amplifier means heater in response to a preselected temperature.

10. The system as defined in claim 9 wherein said means for heating said low noise amplifier means comprises a flexible, electrically heated strip that fits around said low noise amplifier means.

11. The system as defined in claim 9 wherein said means for heating said low noise amplifier means comprises a heated cover that snap fits to said low noise amplifier means, said cover comprising internal resistance windings for electrically generating heat.

* * * * *